United States Patent [19]

Kroth

[11] Patent Number: 4,943,694

[45] Date of Patent: Jul. 24, 1990

[54] PUSH-BUTTON COVER ASSEMBLY

[76] Inventor: Neil Kroth, 4901 Kundinger Ct., Raleigh, N.C. 27606

[21] Appl. No.: 345,290

[22] Filed: May 1, 1989

[51] Int. Cl.[5] ..... H01H 9/02

[52] U.S. Cl. ..... 200/332.1; 200/345; 200/552

[58] Field of Search ..... 200/552, 529, 332.1, 200/330, 345

[56] References Cited

U.S. PATENT DOCUMENTS 3,674,970 7/1972 Bedocs ..... 200/345 X 4,429,200 1/1984 Glenn et al. ..... 200/332.1

FOREIGN PATENT DOCUMENTS 1520451 8/1978 United Kingdom ..... 200/330

*Primary Examiner*—Renee S. Luebke

[57] ABSTRACT

This invention is directed at a push-button cover assembly which includes a housing section and first and second actuators. The housing includes a first side, a second side, a third side, and a fourth side. The first and second sides include vertical channels which are configured to accept and guide annular protuberances formed on the first and second actuators. The third and fourth sides include first and second resilient plates which are formed integrally with the sides and function to engage a support. The housing includes a base portion with a central through hole configured to accept a standard electric rocker switch.

3 Claims, 2 Drawing Sheets

PUSH-BUTTON COVER ASSEMBLY

BACKGROUND OF THE INVENTION

Field of the invention

This invention relates to electric switch cover assembles used to convert electrical switches from rocker to push-button actuation.

SUMMARY OF THE INVENTION

The invention disclosed herein is directed at an electric switch cover assembly which includes a housing, a first push-button and a second push-button. The housing further includes a cavity into which the first and second push-buttons are positioned. In addition, the housing includes a plurality of sides with the first side including first and second channels and the second side including third and fourth channels. The first and second push-buttons include annular protuberances adapted to engage these channels. The housing also includes first and second resilient plates which are located on the outer surface of the third and fourth sides respectively. The resilient plates are adapted to engage an outer support. The positioning of a standard rocker switch within the cavity of the housing before installation of the first and second push-buttons allows conversion of the rocker switch to a push-button switch.

BRIEF DESCRIPTION OF THE DRAWINGS

Further details are explained below with the help of the example(s) illustrated in the attached drawings in which.

DESCRIPTION OF THE PREFERRED EMBODIMENT

Figure 1:
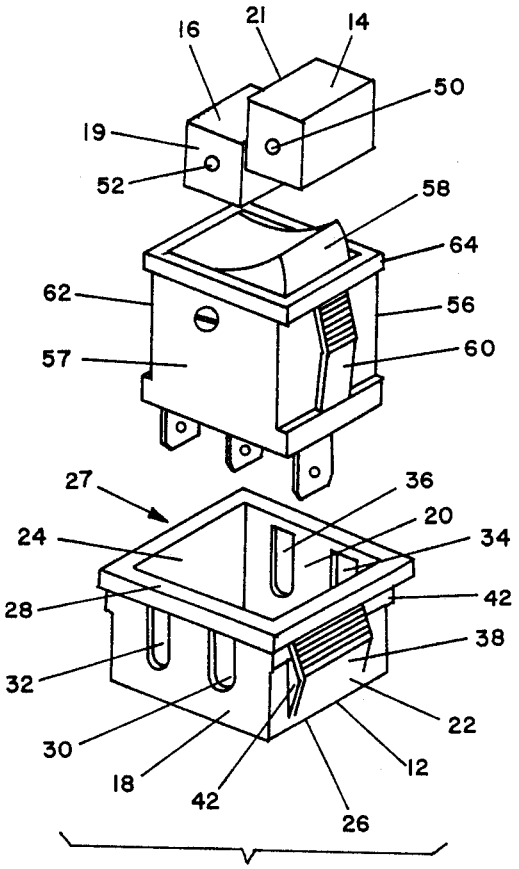
FIG. 1 is an exploded view of the electric switch cover assembly with the accompanying rocker switch according to the present invention.

Shown in the drawings is a push-button cover assembly 10 which comprises a housing section 12, a first actuator 14 and a second actuator 16.

As shown in FIG. 1, the housing section 12 is generally rectangular in configuration and may be formed of resilient nylon or a similar substance. The box-like housing comprises a first side 18, a second side 20, a third side 22, a fourth side 24 and a base portion 26 all of which are formed in integral relation to each other. The sides 18–24 and the base portion 26 define an inner cavity 27. Formed along the top edge of the cavity 27 is a shoulder portion 28.-First and second vertical lines may be drawn on the first side 18. A first channel 30 and a second channel 32 are aligned along these lines extending downward from the joinder of the shoulder portion 28. The channels 30 and 32 which are elongated in configuration include first and second terminal ends with the first terminal end being square in configuration and the second terminal end being rounded in configuration. Similarly, third and fourth channels 34 and 36 are formed in the second side 20. The third and fourth channels 34 and 36 are aligned in spaced, opposed and parallel relation to the first and second channels 30 and 32, respectively. The third channel 34 being in spaced, parallel relation to the first channel 30 and the fourth channel 36 being in spaced, parallel relation to the second channel 32.

The third and fourth sides 22 and 24 include resilient first and second plates 38 and 40, respectively. The first and second plates 38 and 40 are integral formed with the sides 22 and 24. The resilient plate 38 extends upwardly in angular relation from the lower portion of the third side 22 to an apex and thereto the joinder of the third side 22 and the outwardly extending shoulder 28. The resilient plate 38 includes an outwardly open corrugated portion 42 located on the outer surface of the plate 38 between the apex and the joinder of the side 40 and the shoulder 28. The resilient plate 40 extends upwardly in angular relation from the lower portion of the fourth side 24 to an apex and thereto the joinder of the fourth side 24 and the outwardly extending shoulder 28. The resilient plate 40 includes an outwardly open corrugated portion 43 located on the outer surface of the plate 40 between the apex and the joinder of the side 40 and the shoulder 28. When the cover assembly 10 is mounted into a panel hole (not shown) the resilient plates 38 and 40 will tightly engage the sides of the panel hole firmly locking the cover assembly 10 and an accompanying switch 56 in place.

Figure 3:
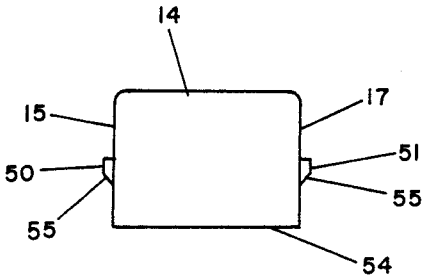
FIG. 3 is a side elevational view of the first push-button, shown in FIG. 1, showing the placement and configuration of the first and second annular protuberances on the sides of the push-button.
Figure 4:
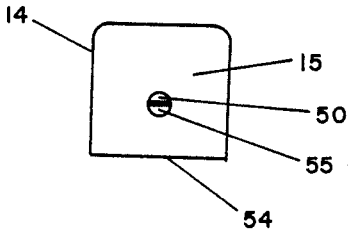
FIG. 4 is an end elevational view of the first push-button, shown in FIG. 3, showing the placement of the first annular protuberance on the side of the push-button.
Figure 5:
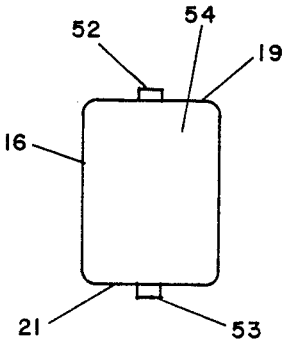
FIG. 5 is a top plan view of the second push-button, shown in FIG. 1, showing the placement of the annular protuberances on the sides of the push-button.

As shown in FIGS. 3 and 4, the first push-button 14 which is generally rectangular in configuration includes first and second annular protuberances 50, 51. The push-button 14 further includes a first side 15 and a second side 17. The annular protuberances 50, 51 are spaced from and in coaxial relation with each other as shown in FIGS. 3 and 5. The protuberances 50 and 51 snap fit into the first and third channels 30 and 34, respectively. After assembly the push-button 14 will move freely in a vertical direction within the channels. Similarly, the second push-button 16 as illustrated in FIG. 5, includes a first protuberance 52 and a second protuberance 53, a first side 19 and a second side 21. The sides 19 and 21 include vertical lines upon which the annular protuberances 52 and 53 are aligned. The protuberances 52 and 53 snap fit into the second and fourth channels 32 and 36, respectively. The protuberances 50 and 51 on push-button 14, as shown in FIG. 3, and the protuberances 52 and 53 on push button 16, as shown in FIG. 5, include ramp portions 55. The ramps 55 are formed at a 60% angle to the central horizontal planes of the push-buttons 14 and 16. The ramps 55 allow the push buttons 14 and 16 to more easily be inserted into the housing section 12. The first and second push-buttons 14 and 16 further include base portions denoted as 54 which are flat in configuration.

Figure 6:
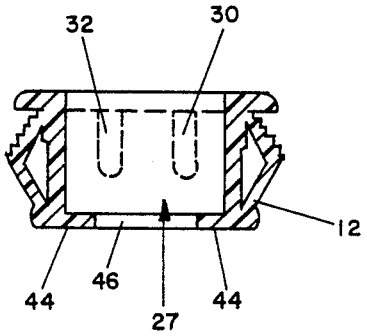
FIG. 6 is a cut-away view of the housing, shown in FIG. 1, showing the configuration of the first and second channels on the first side and the configuration of the cavity in the base portion of the housing.

As shown in FIG. 6, the base portion 26 comprises an integral inner lip 44 and a central through hole 46. The lip 44 extends inwardly towards the central vertical axis of the housing 12 in right angle relation to the sides 18–24. The lip 44 defines the outermost boundary of the through hole 46. The rocker switch 56 is inserted into the through hole 46.

Figure 2:
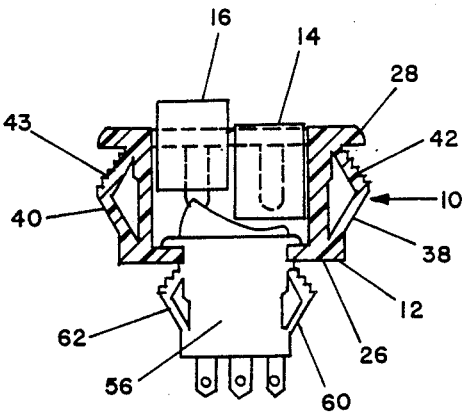
FIG. 2 is a cross sectional view of the cover assembly shown in FIG. 1, showing the placement of the rocker switch within the cavity of the cover assembly.

As illustrated in FIGS. 1 and 2, the rocker switch 56 comprises a housing section 57, and an actuator 58. As shown in this embodiment the housing section 57 of the switch 56 is similar in design to the housing section 12 of the cover assembly 10 and includes a first resilient plate 60, a second resilient plate 62 and a shoulder portion 64. The cover assembly 10 will allow conversion of the standard rocker switch 56 into a push-button switch.

The rocker switch 56 is inserted into the cavity 27 of the housing 12. As the switch is inserted, the resilient plates 60 and 62 engage the lip 44. As the switch continues into the cavity 27 the bottom of the shoulder portion 64 will engage the top of the lip 44. The action of the plates 60 and 62 against the lip 44 locks the switch 56 in place. The first and second push buttons 14 and 16 are inserted into the cavity 27 snap fitting into the appropriate channels. In this manner the switch has been converted into a push-button switch.

The operator presses the appropriate push-button 14 or 16 the actuation of which will trip the actuator 58 forming or breaking the circuit. As the push-button 14 is pressed the actuator 58 is forced down, this action simultaneously forces the push-button 16 up. To change the circuit, the push-button 16 is pressed and this forces the actuator 58 to simultaneously force push-button 14 up.

What I claim is:

1. The combination of an electric switch cover assembly and an electric switch, the electric switch cover assembly comprising a housing, a first push-button and a second push-button; the cover assembly being positioned over the electric switch; the housing including a first side, a second side and a base portion; the first side including a first channel and a second channel; the second side including a third channel and a fourth channel; the first channel being positioned in spaced parallel relation to the third channel; the second channel being positioned in spaced parallel relation to the fourth channel; the first and second push-buttons being adapted to engage the channels; the base portion being integrally formed with the first and second side; the base portion including a central through hole and an inner lip.

2. The combination as recited in claim 1 wherein the housing further includes a third side and a fourth side; the third side including an outer surface; a first resilient plate being located on the outer surface of the third side; the fourth side including an outer surface; a second resilient plate being located on the outer surface of the fourth side; the first resilient plate being formed integrally with the third side; the second resilient plate being formed integrally with the fourth side; the first and second resilient plates being adapted to engage a support.

3. The combination as recited in claim 2 wherein the electric switch cover assembly is positioned over the electric switch; the electric switch extending through the base portion central through hole; the first push-button includes a first and second annular protuberance; the second push-button includes third and fourth annular protuberances; the first and second push-buttons movably mounted within the housing; the annular protuberances fitting within the channels.

* * * * *